US009643098B2

(12) United States Patent
Schneider et al.

(10) Patent No.: US 9,643,098 B2
(45) Date of Patent: May 9, 2017

(54) TOY VEHICLE—DIGGER

(71) Applicant: Franz Schneider GmbH & Co. KG, Neustadt (DE)

(72) Inventors: Frank Schneider, Neustadt (DE); Ulrich Ewringmann, Taufkirchen (DE)

(73) Assignee: Franz Schneider GmbH & Co. KG, Neustadt (DE)

( * ) Notice: Subject to any disclaimer, the term of this patent is extended or adjusted under 35 U.S.C. 154(b) by 0 days.

(21) Appl. No.: 14/800,013

(22) Filed: Jul. 15, 2015

(65) Prior Publication Data

US 2016/0214022 A1 Jul. 28, 2016

(30) Foreign Application Priority Data

Jan. 23, 2015 (DE) ..... 10 2015 000 666

(51) Int. Cl.
*A63H 17/12* (2006.01)
*A63H 17/14* (2006.01)

(52) U.S. Cl.
CPC ..... *A63H 17/14* (2013.01); *A63H 17/12* (2013.01)

(58) Field of Classification Search
CPC ..... A63H 17/14; A63H 17/12
USPC ..... 446/425, 426, 427, 428, 435
See application file for complete search history.

(56) References Cited

U.S. PATENT DOCUMENTS 545,589 A * 9/1895 Kilgore ..... B66C 13/18 212/243
1,566,030 A * 12/1925 Marks ..... A63H 17/12 29/DIG. 81
1,780,806 A * 11/1930 Williams ..... A63H 17/12 212/248
1,939,442 A * 12/1933 Gaver ..... A63H 17/12 414/915
2,247,619 A * 7/1941 Penica ..... A63H 33/3044 414/694
2,589,333 A * 3/1952 Brown ..... A63H 17/12 446/425
2,858,642 A * 11/1958 Giardina ..... A63H 17/12 446/137
2,896,802 A * 7/1959 Hope ..... A63H 33/3044 414/694
2,961,103 A * 11/1960 Ward ..... A63H 17/12 212/241
3,155,250 A * 11/1964 French ..... E02F 3/32 280/456.1

(Continued)

FOREIGN PATENT DOCUMENTS

AT 2140 T * 1/1983
DE 10104353 C1 * 3/2002 ..... A63H 17/12

*Primary Examiner* — Vishu Mendiratta
(74) *Attorney, Agent, or Firm* — Greer, Burns & Crain, Ltd.

(57) ABSTRACT

The toy vehicle with a chassis, on which a vertical shaft with a seat is rotatably arranged, wherein the shaft is rigidly connected to a cantilever arm, pivotally connected to which is an end section of a digger arm, which is provided with a handle and whose other end section is connected to a pivotable bucket arm, which carries a pivotable bucket, is characterised in that tensioned between the cantilever arm and the digger arm there is a spring device, which biases the digger arm into a raised position and is increasingly tensioned when the digger arm is lowered.

7 Claims, 8 Drawing Sheets

(56) References Cited

U.S. PATENT DOCUMENTS

| | | | | | |
|---|---|---|---|---|---|
| 3,205,612 | A | * | 9/1965 | Zbikowski | A63H 17/12<br>414/694 |
| 3,926,316 | A | * | 12/1975 | Luttrell | B66C 23/48<br>212/259 |
| 4,224,007 | A | * | 9/1980 | Chabot | E02F 3/42<br>414/694 |
| 4,435,916 | A | * | 3/1984 | Iwao | A63H 33/003<br>446/470 |

* cited by examiner

TOY VEHICLE—DIGGER

PRIORITY

This application claims priority under 35 U.S.C. §119 to German Application No. 10 2015 000 666.5, filed Jan. 23, 2015.

Field of the Invention

The invention relates to a toy vehicle in the form of a rideable digger.

BACKGROUND OF THE INVENTION

A conventional digger toy vehicle has a chassis, arranged on which is a rotatable seat, which is preferably fastened to a vertical tube, which is rotatably arranged on the chassis. Rigidly connected to the vertical tube is a cantilever arm of the digger, connected to which so as to be pivotable about a horizontal axis is one end section of a digger arm, which is provided with a handle, with which the digger arm is raiseable and lowerable by a person playing. The other end of the digger arm is connected to a bucket arm, which is pivotable about a horizontal axis and carries a bucket, which is also pivotable about a horizontal axis. The bucket arm extends beyond the hinged connection to the digger arm and its free end is pivotally connected to a movably mounted bar, the other end of which is fastened to a pivotable lever, which, for its part, is pivotally connected to the digger arm and with which the person playing can pivot the bucket arm and the bucket.

A person playing handles the digger with both hands, with one hand on the, preferably bracket-shaped, handle, rigidly connected to the digger arm, in order to extend the digger arm and thus the bucket arm and the bucket forwardly or to retract them, and with the other hand on the pivotable lever in order to push the bucket arm with the bucket forwards with respect to the digger arm or to retract them relative to it.

The bucket can be filled, for instance, with sand or stones, whereby a considerable torque is produced, which weighs the digger arm down towards the ground. This implies a considerable risk of injury, particularly when the person situated on the seat and further people playing lingering in the vicinity of the digger are small children. Furthermore, it can require the exertion of a considerable amount of force in order to lift the digger arm with a full bucket and to pull it back into the raised starting position in order to be able to ride with the toy vehicle, for instance to an unloading station.

SUMMARY OF THE INVENTION

It is the object of the present invention to provide a toy vehicle in the form of a rideable digger, in which the manageability is made easier so that the play value of the digger is increased and in which high safety requirements on the toy vehicle are satisfied.

This object is solved in accordance with the invention by providing a toy vehicle with a chassis, rotatably arranged on which is a vertical shaft with a seat. The shaft is rigidly connected to a cantilever arm, to which is pivotally connected one end section of a digger arm provided with a handle, and the other end section of which is connected to a pivotable bucket arm. The bucket arm carries a pivotable bucket. Tensioned between the cantilever arm and the digger arm there is a spring device, which biases the digger arm into a raised position and is increasingly tensioned as the digger arm is lowered.

Further advantageous embodiments of the invention are described below.

The invention provides that stressed between the cantilever arm and the digger arm of the toy vehicle there is a spring device, which biases the digger arm into a raised position and which is increasingly stressed as the digger arm is lowered. This spring device is preferably a helical spring, which has two projecting ends, wherein one end of the spring is retained in the cantilever arm and the other end is retained in the digger arm. The cantilever arm and the digger arm are preferably constituted by U profiles, wherein the two projecting ends of the helical spring are pressed under a biasing force against the central upper wall of the U profiles.

The helical spring is preferably located on a bearing body which internally engages the helical spring and whose peripheral wall is elastically radially compressible by the helical spring so that the helical spring can be radially compressed or expanded on pivotal movement of the digger arm by its ends, which are also pivoted. Fastened in the centre of the bearing body is a sleeve or hub, which accommodates a horizontal shaft, with which the cantilever arm and the digger arm are pivotally connected. This shaft can be constituted by a threaded bolt and an associated nut.

The helical spring is arranged on the pivotal shaft in the stressed state in that its two ends, retained in the digger arm and the cantilever arm, bias the digger arm into the raised starting position determined by an abutment. If the person playing presses the digger arm downwardly in order to extend or advance the entire linkage with the bucket, the helical spring is increasingly stressed and prevents the bucket suddenly striking the ground as a result of gravity because the forward movement is braked by the spring force. Since the downwardly directed torque increases as the linkage is extended and the spring force simultaneously increases, an equilibrium state is roughly possible so that the movement of the digger arm can be effected with the application of a small force. The spring force also facilitates lifting a loaded bucket.

The operability of the digger, particularly for small children, is thus made considerably easier, whereby the safety of the toy vehicle is also significantly increased.

Further contribution to the safety of the toy vehicle is made by the fact that arranged on both lateral halves of the helical spring there can be cover rings, which have a respective slot, through which the associated projecting end of the helical spring engages and permits the rotary movement of the projecting end. Furthermore, the two end faces of the helical spring can be covered by cover discs, which are rotationally fixedly connected to the cantilever arm so that a person playing cannot injure themselves on the helical spring.

It is also advantageously provided that a safety hook is fastened to the digger arm, which overlaps with the cover rings of the helical spring from above and can lock the raised position of the digger arm by engagement into an opening in the cantilever arm.

The bearing body, which is arranged within the helical spring, can have a peripheral wall of peripheral sections separate from one another, which are held by webs, which are fastened to the hub. The bearing body is elastically compressible in this case due to the fact that the spacing between the peripheral sections from one another is elastically reducible.

In accordance with a further proposal of the invention, the cantilever arm, the digger arm, the bucket arm and the bucket are made of metal, as also is the vertical tube, which is rotatably arranged in a sleeve fastened to the chassis and is rigidly connected to the cantilever arm. The digger is thus extremely robust. Despite its high weight associated therewith, the digger may be very easily operated as a result of the special spring device between the cantilever arm and the digger arm.

As to further details, it is proposed that the chassis of the toy vehicle includes two continuous tracks, which are arranged on both sides of the seat and are guided by freely rotating rollers and that the seat is arranged above the continuous tracks such that a person playing who is seated can drive the continuous tracks with their feet. This promotes the skill of the person playing when operating the digger.

Further details of the invention will be apparent from the following description of a preferred embodiment and with reference to the drawings, in which:

DETAILED DESCRIPTION OF PREFERRED EMBODIMENTS

Figure 1:
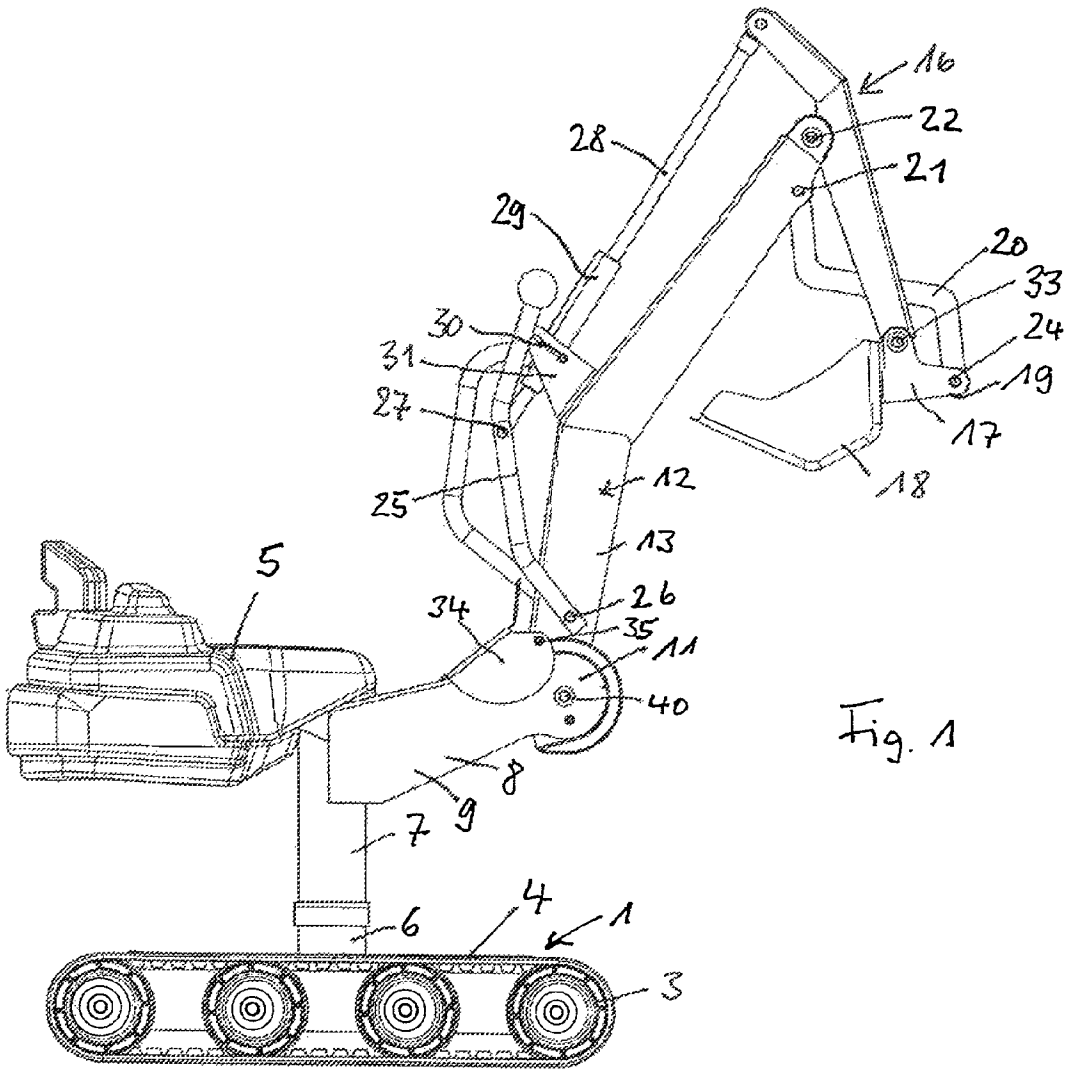
FIG. 1 is a side view of the children's digger.
Figure 2:
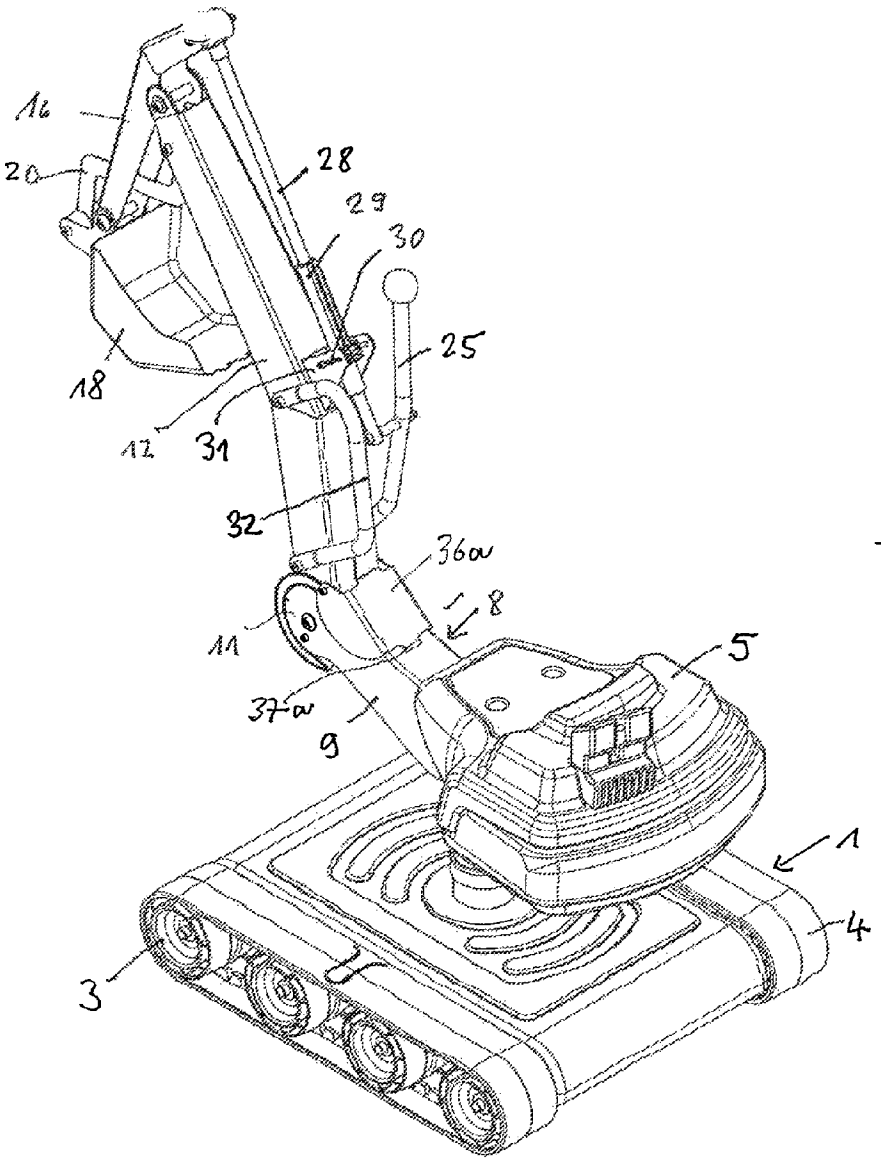
FIG. 2 is a perspective view of the children's digger.
Figure 3:
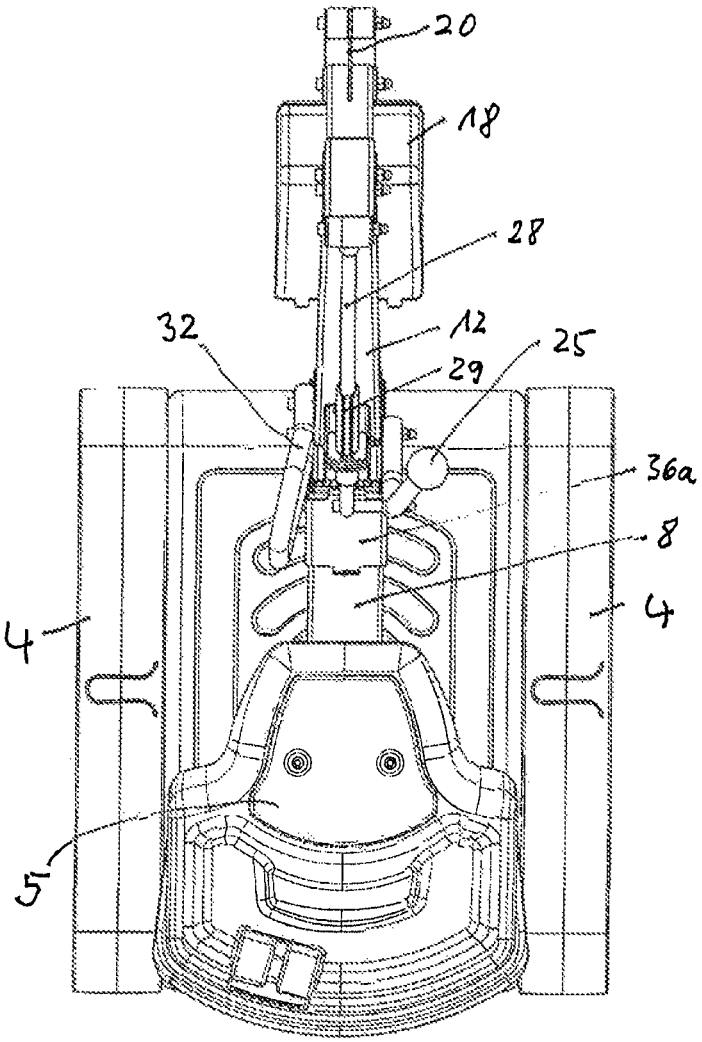
FIG. 3 is a plan view of the children's digger.
Figure 4:
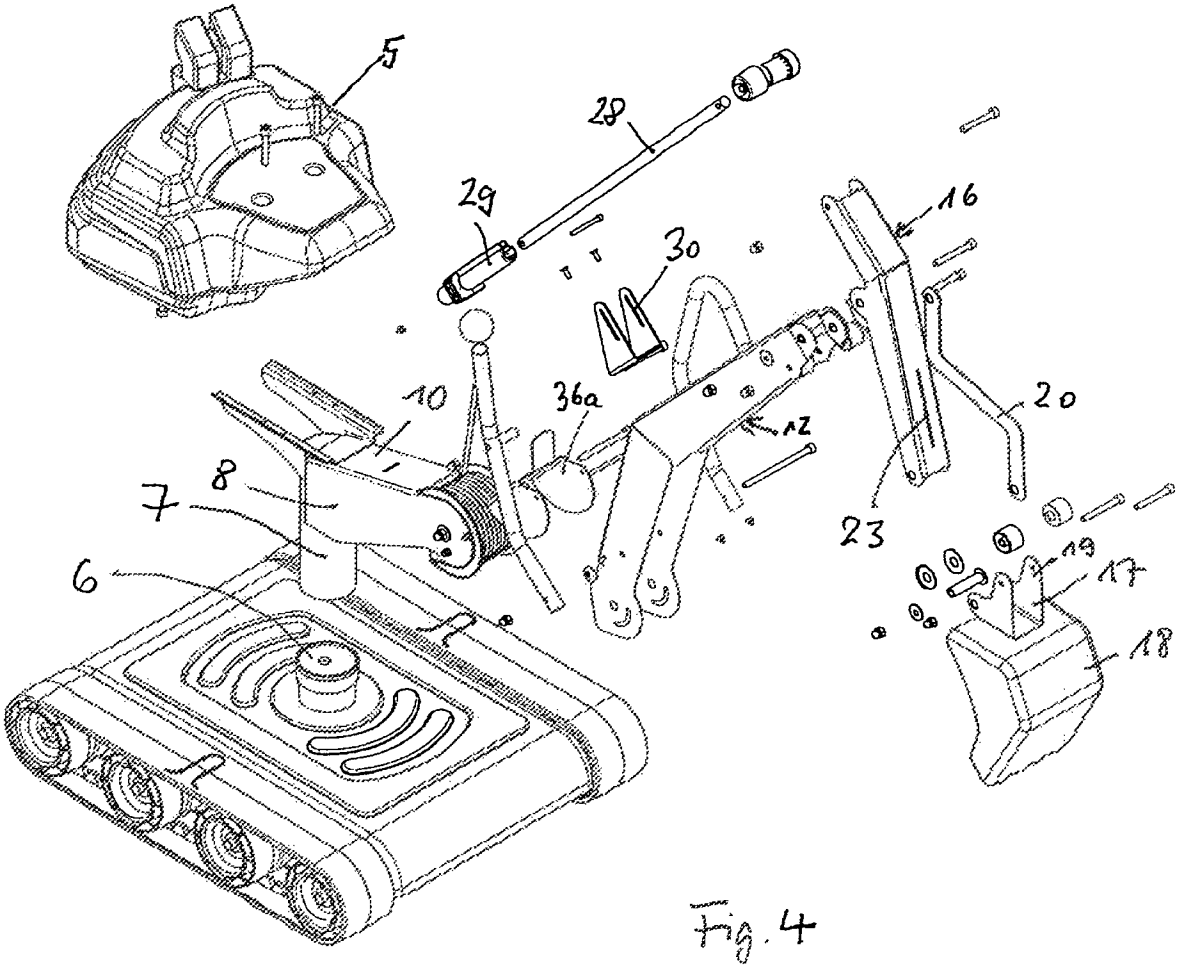
FIG. 4 is an exploded view of the children's digger.
Figure 5:
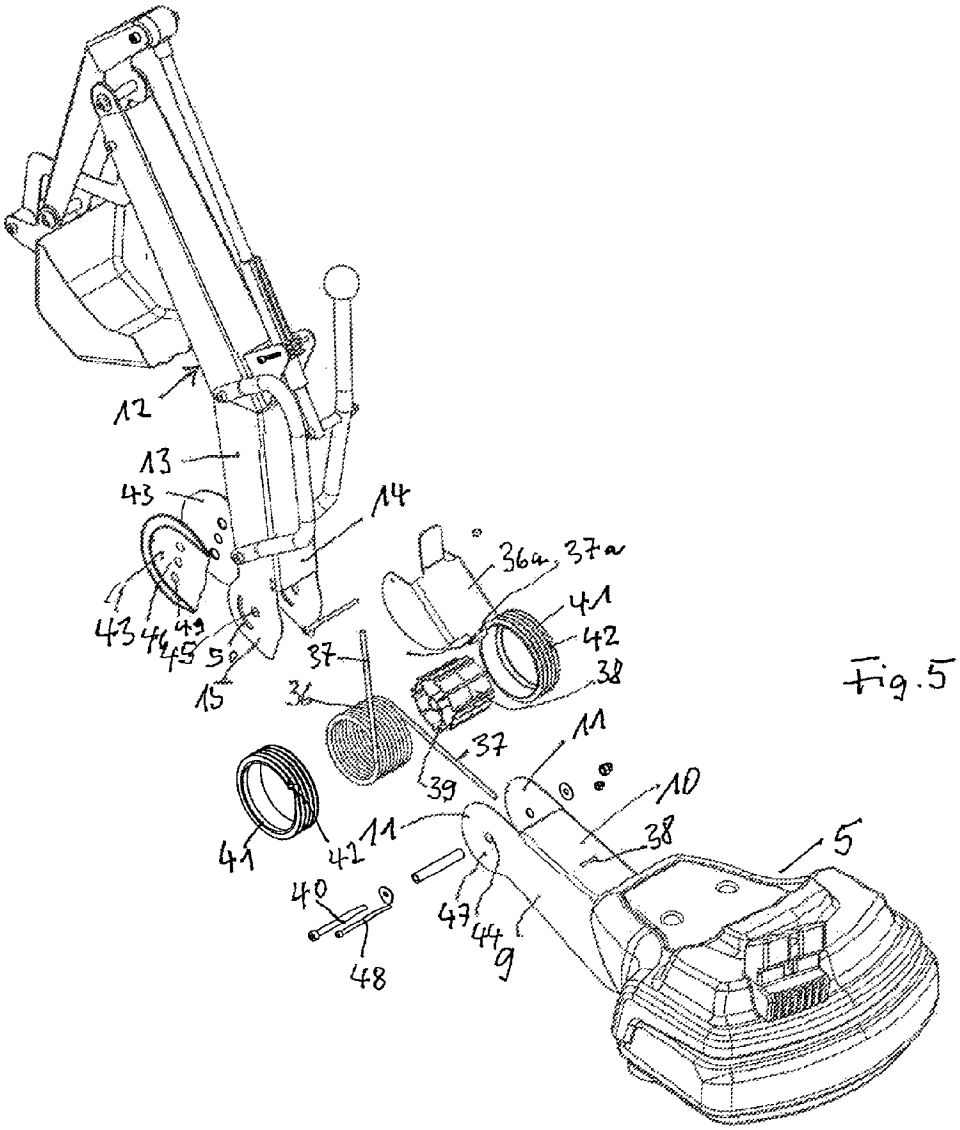
FIG. 5 is an exploded view of the digger arm assembly of the children's digger.
Figure 6:
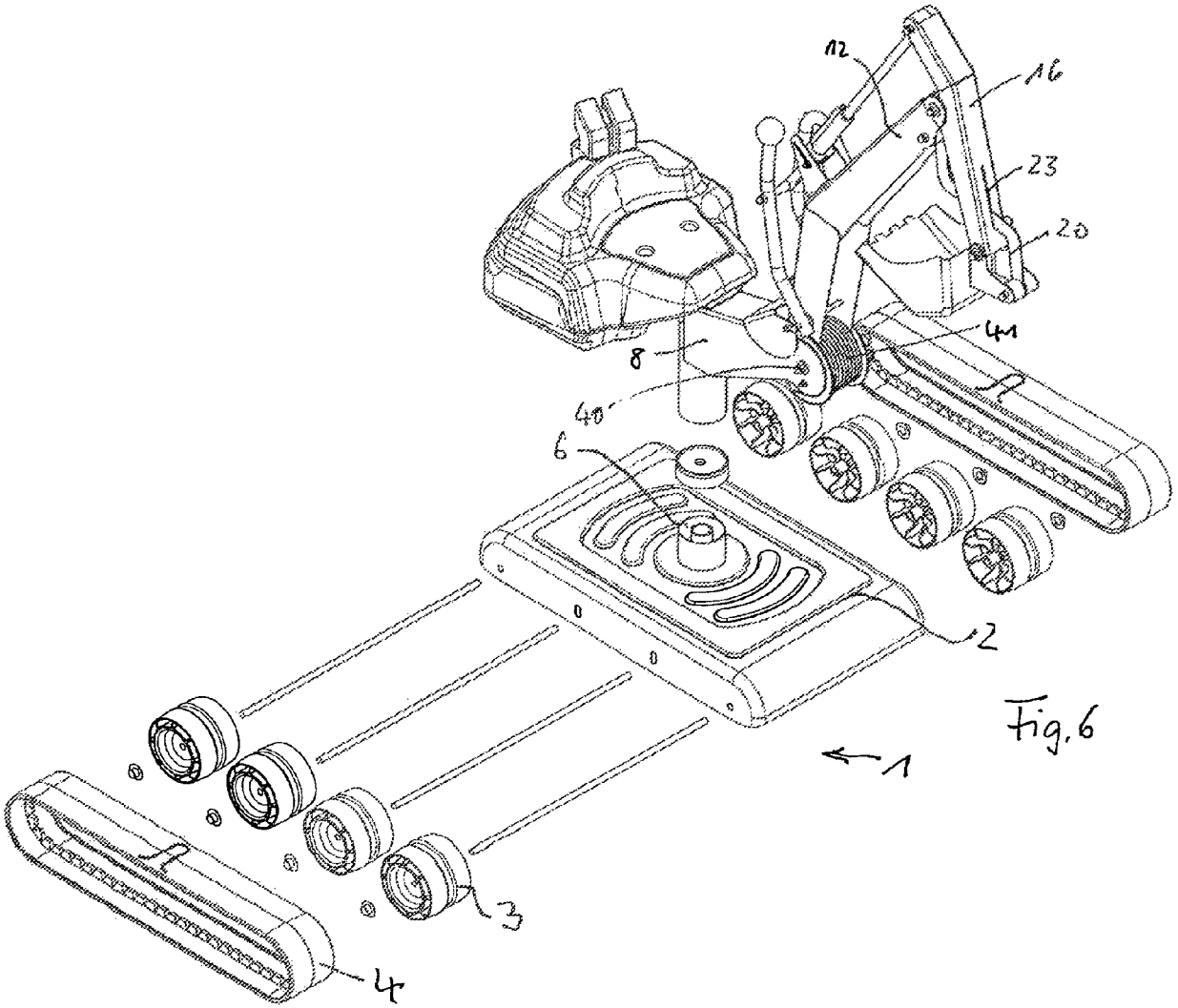
FIG. 6 is an exploded of the chassis of the children's digger.
Figure 7:
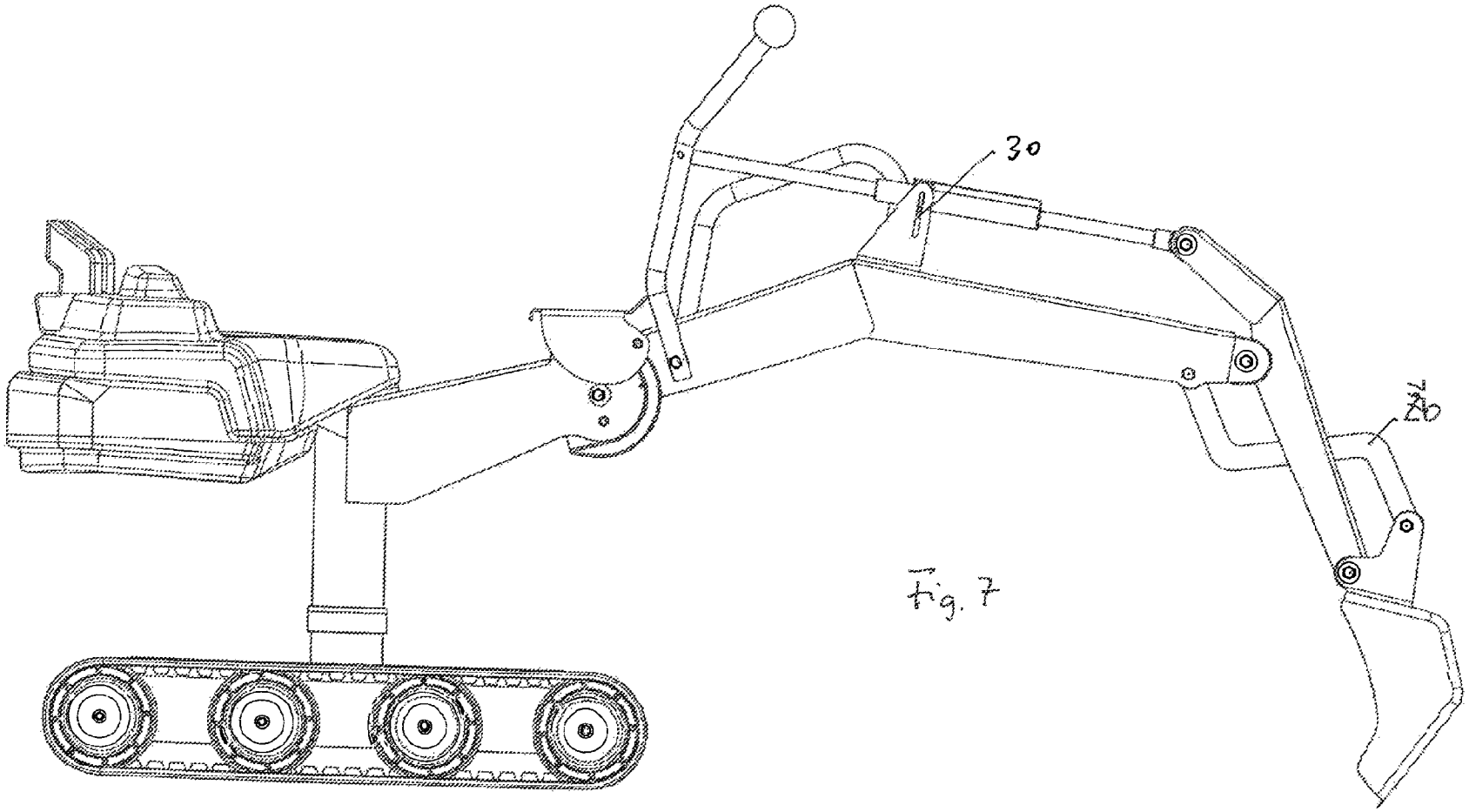
FIG. 7 is a side view of the extended extreme position of the children's digger.
Figure 8:
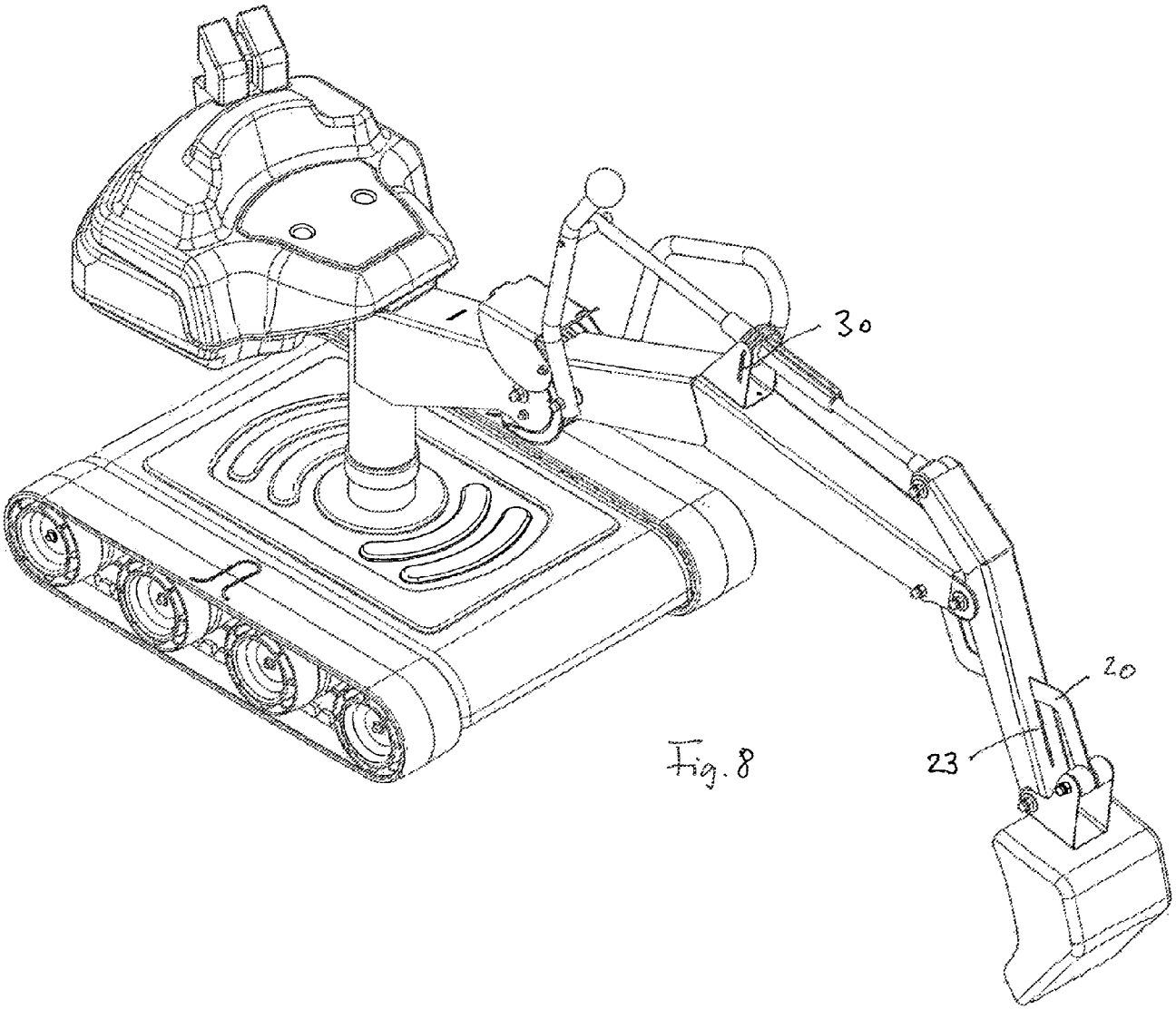
FIG. 8 is a perspective view of the extended position of the children's digger.

The children's digger includes a chassis 1, whose base body 2 is provided with four pairs of freely rotating wheels 3, over which are guided continuous tracks 4, which are drivable in both directions by the feet of a person playing situated on a seat 5.

Fastened to the base body 2 is a sleeve 6, inserted into which is a vertical metallic tube 7, which is rotatably located in the sleeve 6. The tube 7 is welded to a cantilever arm 8, which also consists of metal. The seat 5, which consists of plastic material, is fastened at the rear end section to the cantilever arm 8 by means of the tube 7 so that the seat 5 and the cantilever arm 8 are rotatable together with the tube 7 about a vertical axis.

The cantilever arm 8 has a U shape in cross-section with two lateral webs 9 and a central web 10, wherein two end sections 11 extend from the lateral webs 9 beyond the central web 10. The end sections 11 have edges in the form of a section of a circle.

Pivotally connected to the cantilever arm 8 is an angled digger arm 12, which is also of U shape in cross-section with side walls 13 and a central web 14, beyond which end sections 15 of the side walls 13 project. The digger arm is pivotally connected at its end to a bucket arm 16 at an intermediate position on the bucket arm 16. The bucket arm 16 is pivotally connected at one end to an angled projection 17 on a bucket 18. The other arm of the angled projection 17 is pivotally connected via a Z-shaped bar 20 to an intermediate position 21 on the digger arm 12 at a small spacing from the joint 22. The Z-shaped bar 20 passes through a slot 23 in the bucket arm 16, which limits the tilting movement of the bucket 18 caused by the Z-shaped bar 20 when the digger arm 16 pivots. The Z-shaped bar 20 is rigidly connected at 24 to the arm 19 of the angled projection 17.

Pivotally fastened (joint 26) to a side wall 13 of the digger arm 12 is a lever 25, which is pivotally connected at an intermediate position to a straight bar 28. The bar 28 is slidably retained by a sleeve 29, which, for its part, is retained in slots 30 in a projection 31 of U-shaped cross-section so as to be movable transversely to the longitudinal axis of the bar 28 and thus transversely to its direction of movement, which projection is rigidly fastened to the central web 14 of the digger arm 12 by being welded to it.

Rigidly fastened to the other side wall 13 of the digger arm 12 is a bracket 32, with which the person playing can extend the digger arm 12 with the bucket arm 16 and the bucket 18 forwardly or can retract it. As a result of pivotal movement of the lever 25, the bucket 18 is advanced or retracted, wherein the bucket 18 performs a tilting movement about the joint 33 as a result of the Z-shaped bar 20. A safety plate 34 of U-shaped cross-section is pivotally connected at 35 with its side walls to the side walls 13 of the digger arm 12 and a lug 37 angled downwardly and projecting from its upper wall 36 engages as a result of transverse force into a slot 38 in the upper wall of the cantilever arm 8 when the digger arm 12 is situated in the rear, retracted end position in order to lock or to secure the digger arm 12 with the linkage mounted by it in this starting position of the toy digger.

Located between the cantilever arm 8 and the digger arm 12 is a helical spring 36, which has two straight end sections 37, which engage under a biasing force beneath the wall 14 of the digger arm 12 and beneath the wall 10 of the cantilever arm 8 and urge the digger arm 12 into the raised, retracted starting position, which is shown in FIG. 1. The helical spring 36 is also stressed in the starting position.

The helical spring 36 engages around a bearing body 38, which, by way of inner webs, holds a central sleeve or hub 39, through which is pushed the horizontal shaft 40, which pivotally connects the cantilever arm 8 and the digger arm 12. The horizontal shaft 40 consists of a threaded bolt with an associated nut. Located on the helical spring 36 are two halves of a cover ring 41, which have slots 42, through which the ends 37 of the helical spring 30 engage, and permit their movement when the helical spring 36 is additionally stressed or relaxed.

The two halves 41 of the cover ring prevent the person playing being able to injure himself by contacting the spring.

Also firmly attached to the inner surface of the two projecting sections 11 of the side walls 9 of the cantilever arm 8 are cover discs 43, which also provide safety for the person playing. The horizontal shaft 40 is guided through the holes 44 in the cantilever arm 8 and the holes 45 aligned with them in the digger arm 12 and also through the central holes 46 of three holes in the cover discs 43. Situated below the holes 44 in the cantilever arm 8 are further holes 47, through which extends a threaded peg 48, which also passes through the aligned holes 49 in the cover discs 43 and slots 50 in the sections 15 of the digger arm 12. The slots 50 have the shape of a section of a circle and define the angle through which the digger arm 12 can be pivoted.

The helical spring 36 engages the peripheral wall of the bearing body 38, which consists of plastic material, and can elastically compress it if the helical spring 36 is additionally stressed by a forwardly directed pivotal movement of the digger arm 12. The bearing bodies 38 can consist for this purpose of separate peripheral sections, which are movable toward one another.

When the toy digger is moved out of the starting position illustrated in FIG. 1 into a working position, in which the digger arm 12 is pivoted forwardly, the helical spring 36 is additionally stressed and acts as an opposing force against the torque acting in the clockwise direction in FIG. 1 as a consequence of the weight of the linkage and the bucket. The rotary movement of the digger arm is thus slowed down and can be controlled even by a small person playing so that the bucket 18 is prevented from falling forcefully onto the floor, which could result in injury. The spring force also facilitates the lifting of the bucket which, when it is loaded, can have a considerable weight.

It is stressed that the invention is not limited to the described and illustrated embodiments and instead all the disclosed features may be individually combined with one another in any meaningful manner.

The invention claimed is:

1. A toy vehicle comprising:

a chassis;

a vertical shaft rotatably arranged on the chassis;

a seat affixed to the vertical shaft;

a cantilever arm rigidly connected to the vertical shaft;

a digger arm pivotally connected on one end by a horizontal shaft to the cantilever arm;

a handle attached to the digger arm;

a bucket arm pivotally connected to another end of the digger arm, a bucket pivotally connected to the bucket arm;

a helical spring having two projecting end sections, wherein one end section is retained in the cantilever arm and the other end section is retained in the digger arm;

wherein the helical spring biases the digger arm into a raised position and is increasingly tensioned as the digger arm is lowered to thereby brake downward movement of the bucket and to assist lifting the bucket when loaded; and a bearing body located within and engaging the helical spring internally, the bearing body having a hub in its centre that receives the horizontal shaft, the bearing body having a peripheral wall that is elastically radially compressible by the helical spring so that the helical spring can be radially compressed or expanded on pivotal movement of the digger arm.

2. A toy vehicle as claimed in claim 1 wherein the helical spring includes two lateral halves, the toy vehicle further comprising two cover rings arranged on the respective lateral halves of the helical spring, each cover ring having a respective slot, through which an associated projecting end section of the helical spring passes and permits its rotary movement.

3. A toy vehicle as claimed in claim 2 wherein a safety plate is pivotally connected to the digger arm, which covers the cover rings of the helical spring from above and locks the raised position of the digger arm by engagement of a hook-shaped projection into an opening in the cantilever arm.

4. A toy vehicle as claimed in claim 1, wherein the helical spring includes two end faces, the toy vehicle further comprising two cover discs covering, respectively, the two end faces of the helical spring, the cover discs being rotationally fixedly connected to the cantilever arm.

5. A toy vehicle as claimed in claim 1 wherein pivotally connected to the digger arm there is a lever, which is connected by means of a rod to the free end of the bucket arm in order to pivot it.

6. A toy vehicle as claimed in claim 1 wherein the cantilever arm, the digger arm, the bucket arm and the bucket are comprised of metal.

7. A toy vehicle as claimed in claim 1 wherein the chassis includes two continuous tracks, which are arranged respectively on opposing sides of the seat and are guided by freely rotating rollers and wherein the seat is arranged above the continuous tracks.

* * * * *